US006471572B2

(12) United States Patent
Skinner

(10) Patent No.: US 6,471,572 B2
(45) Date of Patent: Oct. 29, 2002

(54) TIRE RESURFACING DEVICE

(76) Inventor: Keith C. Skinner, 74 High St., Shoreham, Sevenoaks, Kent TN14 7TE (GB)

( * ) Notice: Subject to any disclaimer, the term of this patent is extended or adjusted under 35 U.S.C. 154(b) by 150 days.

(21) Appl. No.: 09/732,553

(22) Filed: Dec. 8, 2000

(65) Prior Publication Data

US 2002/0072315 A1 Jun. 13, 2002

(51) Int. Cl.[7] ..... B24B 29/02
(52) U.S. Cl. ..... 451/312; 451/920
(58) Field of Search ..... 451/312, 340, 451/434, 443, 444, 459, 487, 490, 508, 523, 524, 525, 920; 157/13

(56) References Cited

U.S. PATENT DOCUMENTS 4,077,733 A * 3/1978 Immonen ..... 144/227
4,235,383 A * 11/1980 Clark ..... 241/224
4,306,607 A * 12/1981 Curry ..... 157/13
4,515,200 A * 5/1985 Williams ..... 156/116
4,782,881 A * 11/1988 Brinkley et al. ..... 157/13
4,805,684 A * 2/1989 Brinkley et al. ..... 157/13
5,193,600 A * 3/1993 Kinuhata et al. ..... 157/13
5,279,076 A * 1/1994 Healy et al. ..... 157/13

* cited by examiner

*Primary Examiner*—Joseph J. Hail, III
*Assistant Examiner*—David B. Thomas

(57) ABSTRACT

A tire resurfacing device for raising a rear wheel of a motorcycle off of the ground and rounding the surface thereof. The tire resurfacing device includes a base portion. The base portion has a first and second portion integrally coupled together. The first portion lies in a plane generally perpendicular to a plane of the second portion. The second portion has a free end having a platform thereon. A grinding assembly includes a rod. The rod is elongate and has a first and second end. The first end is hingedly coupled to a free end of the first portion. A bracket member has a concave inner surface. The bracket has an exterior surface. The second end of the rod is fixedly coupled to the exterior surface of the bracket member. The bracket member has a plurality of apertures therein. An abrasive pad is removably coupled to the inner surface of the bracket. The abrasive pad has a plurality of openings therein. A plurality of fastening means fastens the abrasive pad to the bracket. A motorcycle is balanced on the platform so that the rear wheel may turn freely and may be ground with the grinding assembly.

5 Claims, 2 Drawing Sheets

TIRE RESURFACING DEVICE

BACKGROUND OF THE INVENTION

1. Field of the Invention

The present invention relates to tire resurfacing devices and more particularly pertains to a new tire resurfacing device for raising a rear wheel of a motorcycle off of the ground and rounding the surface thereof.

2. Description of the Prior Art

The use of tire resurfacing devices is known in the prior art. More specifically, tire resurfacing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,105,316; 3,646,984; 1,658,852; 5,026,047; 4,358,893; and U.S. Des. Pat. No. 306,193.

While these devices fulfill their respective, particular objectives and requirements, the aforementioned patents do not disclose a new tire resurfacing device. The inventive device includes a base portion. The base portion has a first and second portion integrally coupled together. The first portion lies in a plane generally perpendicular to a plane of the second portion. The second portion has a free end having a platform thereon. A grinding assembly includes a rod. The rod is elongate and has a first and second end. The first end is hingedly coupled to a free end of the first portion. A bracket member has a concave inner surface. The bracket has an exterior surface. The second end of the rod is fixedly coupled to the exterior surface of the bracket member. The bracket member has a plurality of apertures therein. An abrasive pad is removably coupled to the inner surface of the bracket. The abrasive pad has a plurality of openings therein. A plurality of fastening means fastens the abrasive pad to the bracket. A motorcycle is balanced on the platform so that the rear wheel may turn freely and may be ground with the grinding assembly.

In these respects, the tire resurfacing device according to the present invention substantially departs from the conventional concepts and designs of the prior art, and in so doing provides an apparatus primarily developed for the purpose of raising a rear wheel of a motorcycle off of the ground and rounding the surface thereof.

SUMMARY OF THE INVENTION

In view of the foregoing disadvantages inherent in the known types of tire resurfacing devices now present in the prior art, the present invention provides a new tire resurfacing device construction wherein the same can be utilized for raising a rear wheel of a motorcycle off of the ground and rounding the surface thereof.

The general purpose of the present invention, which will be described subsequently in greater detail, is to provide a new tire resurfacing device apparatus and method which has many of the advantages of the tire resurfacing devices mentioned heretofore and many novel features that result in a new tire resurfacing device which is not anticipated, rendered obvious, suggested, or even implied by any of the prior art tire resurfacing devices, either alone or in any combination thereof.

To attain this, the present invention generally comprises a base portion. The base portion has a first and second portion integrally coupled together. The first portion lies in a plane generally perpendicular to a plane of the second portion. The second portion has a free end having a platform thereon. A grinding assembly includes a rod. The rod is elongate and has a first and second end. The first end is hingedly coupled to a free end of the first portion. A bracket member has a concave inner surface. The bracket has an exterior surface. The second end of the rod is fixedly coupled to the exterior surface of the bracket member. The bracket member has a plurality of apertures therein. An abrasive pad is removably coupled to the inner surface of the bracket. The abrasive pad has a plurality of openings therein. A plurality of fastening means fastens the abrasive pad to the bracket. A motorcycle is balanced on the platform so that the rear wheel may turn freely and may be ground with the grinding assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially. the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tire resurfacing device apparatus and method which has many of the advantages of the tire resurfacing devices mentioned heretofore and many novel features that result in a new tire resurfacing device which is not anticipated, rendered obvious, suggested, or even implied by any of the prior art tire resurfacing devices, either alone or in any combination thereof.

It is another object of the present invention to provide a new tire resurfacing device which may be easily and efficiently manufactured and marketed.

It is a further object of the present invention to provide a new tire resurfacing device which is of a durable and reliable construction.

An even further object of the present invention is to provide a new tire resurfacing device which is susceptible of a low cost of manufacture with regard to both materials and labor, and which accordingly is then susceptible of low prices of sale to the consuming public, thereby making such tire resurfacing device economically available to the buying public.

Still yet another object of the present invention is to provide a new tire resurfacing device which provides in the apparatuses and methods of the prior art some of the advantages thereof, while simultaneously overcoming some of the disadvantages normally associated therewith.

Still another object of the present invention is to provide a new tire resurfacing device for raising a rear wheel of a motorcycle off of the ground and rounding the surface thereof.

Yet another object of the present invention is to provide a new tire resurfacing device which includes a base portion. The base portion has a first and second portion integrally coupled together. The first portion lies in a plane generally perpendicular to a plane of the second portion. The second portion has a free end having a platform thereon. A grinding assembly includes a rod. The rod is elongate and has a first and second end. The first end is hingedly coupled to a free end of the first portion. A bracket member has a concave inner surface. The bracket has an exterior surface. The second end of the rod is fixedly coupled to the exterior surface of the bracket member. The bracket member has a plurality of apertures therein. An abrasive pad is removably coupled to the inner surface of the bracket. The abrasive pad has a plurality of openings therein. A plurality of fastening means fastens the abrasive pad to the bracket. A motorcycle is balanced on the platform so that the rear wheel may turn freely and may be ground with the grinding assembly.

Still yet another object of the present invention is to provide a new tire resurfacing device that quickly and efficiently rounds the surface of a tire to improve traction without having to purchase a new tire.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
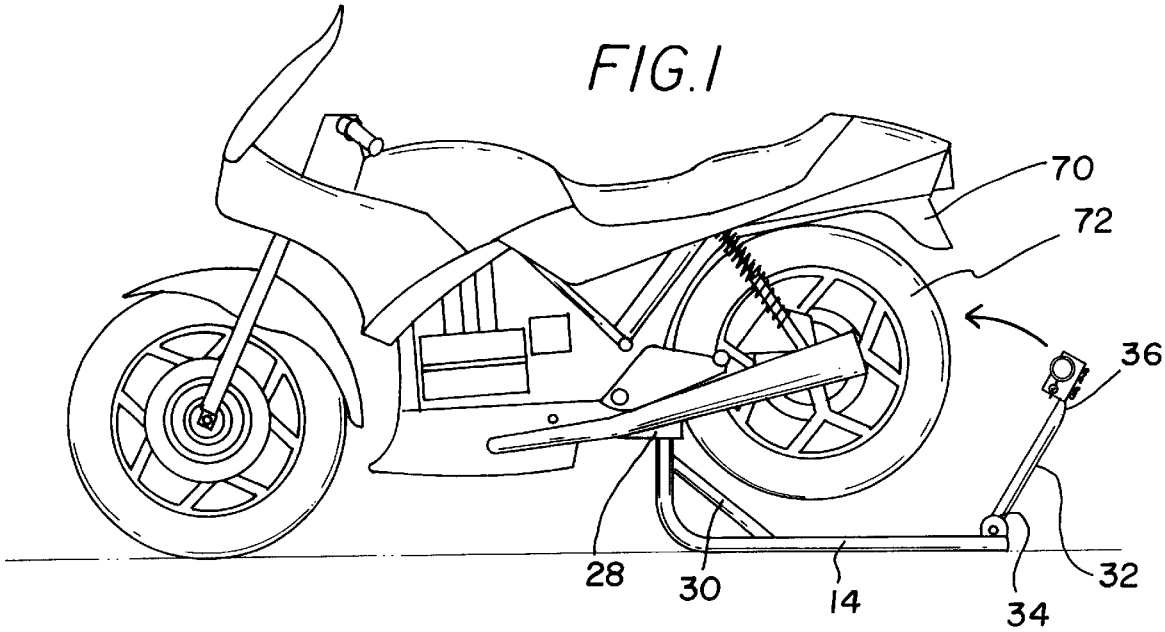
FIG. 1 is a schematic side view of a new tire resurfacing device according to the present invention.
Figure 2:
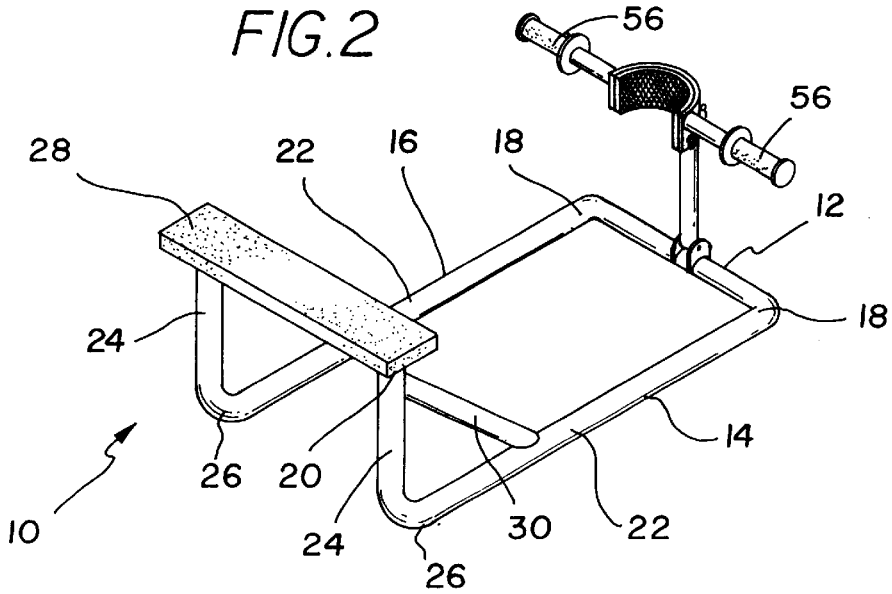
FIG. 2 is a schematic perspective view of the present invention.
Figure 3:
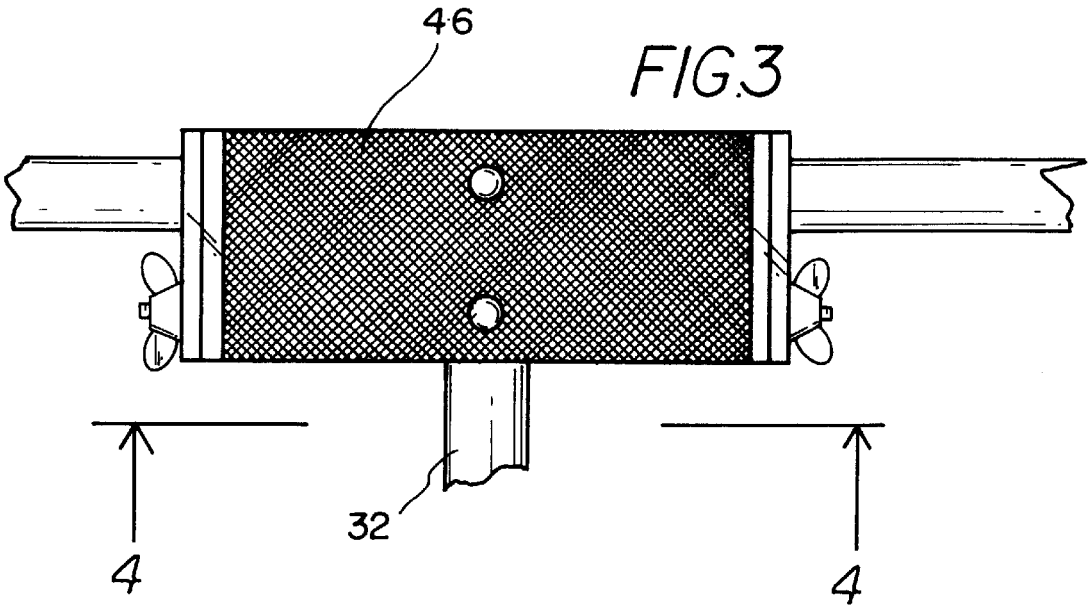
FIG. 3 is a schematic front view of the bracket of the present invention.
Figure 4:
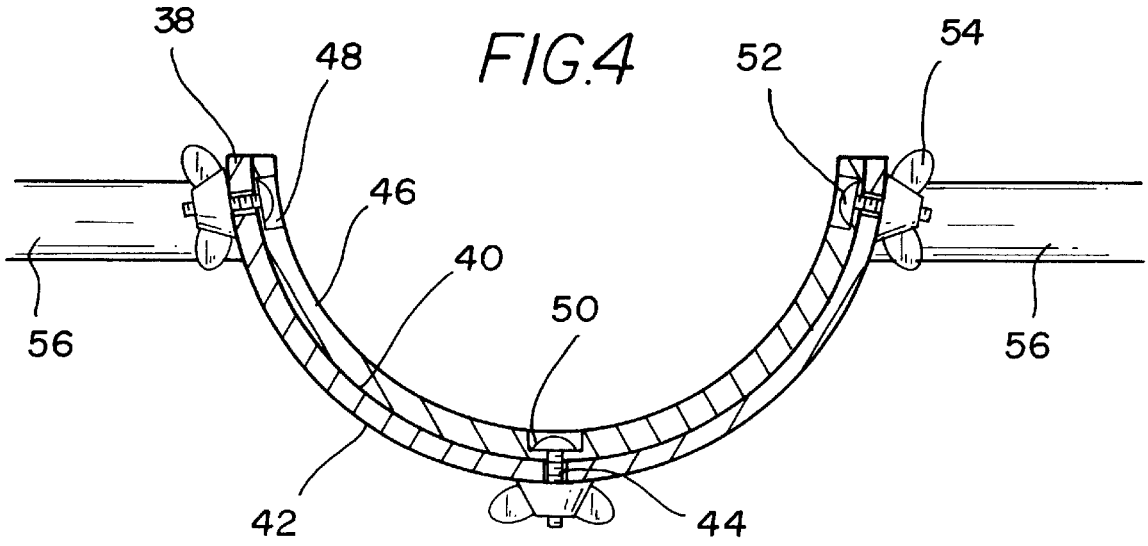
FIG. 4 is a schematic top view of the bracket of the present invention.

With reference now to the drawings, and in particular to FIGS. 1 through 4 thereof, a new tire resurfacing device embodying the principles and concepts of the present invention and generally designated by the reference numeral 10 will be described.

As best illustrated in FIGS. 1 through 4, the tire resurfacing device 10 generally comprises a base portion. The base portion generally comprises a first portion and a second portion orientated generally perpendicular to each other. The first portion is comprised of a first bar 12 coupled to a second 14 and third bar 16. The second portion is formed from a bend 26 in the second and third bars.

The first bar 12 has a pair of ends and is generally tubular. The second 14 and third 16 bars each have a first 18 and second end 20. Each of the second 14 and third 16 bars has a distal portion 22 and a proximal portion 24. Each of the first ends 18 of the second 14 and third 16 bars is integrally coupled to an end of the first bar 12 such that the second 14 and third 16 bars extend away from the first bar 12 in a generally parallel direction. The second 14 and third 16 bars each has a bend 26 therein such that an angle between each of the distal portions 22 and a respective proximal portion 24 is substantially equal to 90 degrees. The bend 26 is generally nearer the second ends 20 than the first ends 18 of the second 14 and third 16 bars.

A platform 28, which is elongate, has a generally planar upper and lower surface. The bottom surface of the platform extends between and is fixedly coupled to the second ends 20 of the second 14 and third 16 bars. Preferably, the platform 28 has a generally rectangular shape.

A pair of support bars 30 is each integrally coupled to and extends between one of the distal portions 24 and its respectively adjacent proximal portion 22.

A grinding assembly includes a rod 32. The rod 32 is elongate and has a first 34 and second 36 end. The first end 34 is hingedly coupled to a central portion of the first bar 12.

A bracket member comprises a curved plate 38 having a concave inner surface 40. The concave surface 40 has a generally semi-circular shape. The bracket has an exterior surface 42, which is fixedly coupled to the second end 36 of the rod 32, such that when the rod 32 is orientated generally perpendicular to the proximal portions 22 of the second 14 and third 16 bar the inner surface 40 generally faces the platform 28. The plate 38 has a plurality of apertures 44 therein.

An abrasive pad 46 is removably coupled to the inner surface 40 of the bracket. The abrasive pad 46 has a plurality of openings 48 therein. The openings 48 are positioned to become aligned with the apertures 44, and each of the openings has shoulder 50 therein. The abrasive pads 46 may be any conventional abrasive pad used for grinding purposes such as those with metal or glass fibers imbedded within.

A plurality of fastening means fasten the abrasive pad 46 to the bracket. Each of the fastening means comprises a screw 52 and a nut 54. Each of the screws 52 is positionable in one of the openings 48 and extends through the apertures 44 such that a head of the screws may be abutted against the shoulders 50.

A pair of handles 56 is each comprised of an elongate member. Each has an end coupled to the exterior surface 42 of the plate 38. The handles 56 extend in generally opposite directions. The handles may have grips thereon as in FIG. 2.

In use, the motorcycle 70 is placed on the platform 28 so that the back tire 72 is lifted off of the ground. The wheel 72 is caused to rotate and the abrasive pad 46 is placed against the tire 72 to round the edges, which tend to become relatively squared off due to uneven wear.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tire resurfacing device for removing the outside edges of a rear motorcycle tire, said device comprising:

a base portion, said base portion having a first and second portion integrally coupled together, said first portion lying in a plane generally perpendicular to a plane of said second portion, said second portion having a free end having a platform thereon;

a grinding assembly, said grinding assembly comprising:

a rod, said rod being elongate and having a first and second end, said first end being hingedly coupled to a free end of said first portion;

a bracket member, said bracket member having a concave inner surface, said bracket having an exterior surface, said second end of said rod being fixedly coupled to said exterior surface of said bracket member said bracket member having a plurality of apertures therein;

an abrasive pad, said abrasive pad being removably coupled to said inner surface of said bracket, said abrasive pad having a plurality of openings therein; and a plurality of fastening means for fastening said abrasive pad to said bracket.

2. The tire resurfacing device as in claim 1, wherein said fastening means further comprises:

each of said fastening means comprising a screw and a nut, each of said screws being positionable in one of said openings and extending through said apertures;

a pair of handles, each of said handles comprising elongate members each having an end coupled to said exterior surface of said bracket, said handles extending in generally opposite directions.

3. The tire resurfacing device as in claim 1, said grinding assembly further comprising:

a pair of handles, each of said handles comprising elongate members each having an end coupled to said exterior surface of said bracket, said handles extending in generally opposite directions.

4. A tire resurfacing device for removing the outside edges of a rear motorcycle tire, said device comprising:

a base portion, said base portion comprising:

a first bar having a pair of ends;

a second and third bar each having a first and second end, each of said second and third bars having a distal portion and a proximal portion, each of said first ends of said second and third bars being integrally coupled to an end of said first bar such that said second and third bars extend away from said first bar in a generally parallel direction, said second and third bars each having a bend therein such that an angle is formed between each of said distal portions and a respective proximal portion;

a platform, said platform being elongate, said platform having a generally planar upper and lower surface, said bottom surface of said platform extending between and being fixedly coupled to said second ends of said second and third bars;

a grinding assembly, said grinding assembly comprising:

a rod, said rod being elongate and having a first and second end, said first end being hingedly coupled to a central portion of said first bar;

a bracket member, having a concave inner surface, said bracket having an exterior surface, said second end of said rod being fixedly coupled to said exterior surface of said bracket member such that when said rod is orientated generally perpendicular to said proximal portions of said second and third bar said inner surface generally faces said platform, said bracket member having a plurality of apertures therein;

an abrasive pad, said abrasive pad being removably coupled to said inner surface of said bracket, said abrasive pad having a plurality of openings therein, said openings being positioned to become aligned with said apertures;

a plurality of fastening means for fastening said abrasive pad to said bracket.

5. A tire resurfacing device for removing the outside edges of a rear motorcycle tire, said device comprising:

a base portion, said base portion comprising:

a first bar having a pair of ends, said first bar being generally tubular;

a second and third bar each having a first and second end, each of said second and third bars having a distal portion and a proximal portion, each of said first ends of said second and third bars being integrally coupled to an end of said first bar such that said second and third bars extend away from said first bar in a generally parallel direction, said second and third bars each having a bend therein such that an angle between each of said distal portions and a respective proximal portion is substantially equal to 90 degrees, said bend being generally nearer said second ends than said first ends of said second and third bars;

a platform, said platform being elongate, said platform having a generally planar upper and lower surface, said bottom surface of said platform extending between and being fixedly coupled to said second ends of said second and third bars, said platform having a generally rectangular shape;

a pair of support bars, each of said support bars being integrally coupled to and extending between one of said distal portions and its respectively adjacent proximal portion;

a grinding assembly, said grinding assembly comprising:

a rod, said rod being elongate and having a first and second end, said first end being hingedly coupled to a central portion of said first bar;

a bracket member, said bracket member comprising curved plate having a concave inner surface, said concave surface having a generally semi-circular shape, said bracket having an exterior surface, said second end of said rod being fixedly coupled to said exterior surface of said bracket member such that when said rod is orientated generally perpendicular to said proximal portions of said second and third bar said inner surface generally faces said platform, said plate having a plurality of apertures therein;

an abrasive pad, said abrasive pad being removably coupled to said inner surface of said bracket, said abrasive pad having a plurality of openings therein, said openings being positioned to become aligned with said apertures, each of said openings having shoulder therein;

a plurality of fastening means for fastening said abrasive pad to said bracket, each of said fastening means comprising a screw and a nut, each of said screws being positionable in one of said openings and extending through said apertures such that a head of said screws may be abutted against said shoulders; and a pair of handles, each of said handles comprising elongate members each having an end coupled to said exterior surface of said plate, said handles extending in generally opposite directions.

* * * * *